United States Patent [19]

Mahncke

[11] 4,319,375

[45] Mar. 16, 1982

[54] DEVICE FOR FOLDING THE SPANS OF A BRIDGE FOR TRANSPORT ON A VEHICLE

[75] Inventor: Jürgen Mahncke, Korntal, Fed. Rep. of Germany

[73] Assignee: Dr. Ing. h.c.F. Porsche Aktiengesellschaft, Stuttgart, Fed. Rep. of Germany

[21] Appl. No.: 97,123

[22] Filed: Nov. 26, 1979

[30] Foreign Application Priority Data

Nov. 24, 1978 [DE] Fed. Rep. of Germany ..... 2850849

[51] Int. Cl.[3] ..... E01D 15/12

[52] U.S. Cl. ..... 14/2.4; 14/27

[58] Field of Search ..... 14/27, 14, 2.4, 2.6; 52/650, 696

[56] References Cited

U.S. PATENT DOCUMENTS

| | | | |
|---|---|---|---|
| 840,636 | 1/1907 | Lillow | 52/650 X |
| 2,341,166 | 2/1944 | Todd | 14/27 X |
| 2,384,409 | 9/1945 | Watter | 52/650 |
| 3,009,326 | 11/1961 | Williams | 14/27 X |
| 3,021,544 | 2/1962 | Gillois | 14/2.6 X |
| 3,143,827 | 8/1964 | Stowalter | 52/650 X |
| 3,343,321 | 9/1967 | Axelsson | 52/650 X |
| 4,073,025 | 2/1978 | Peckham | 14/2.4 |
| 4,100,708 | 7/1978 | Bobrovnikov | 52/650 X |

*Primary Examiner*—Nile C. Byers, Jr.

*Attorney, Agent, or Firm*—Craig and Antonelli

[57] ABSTRACT

A transportable bridge unit has bridge spans located side-by-side and held apart with a space between the spans by crosspieces which include spars connected heightwise to the bridge spans and to a central transverse web in a manner that enables the spans to change their positions relative to each other. According to a preferred embodiment, holders are provided for interconnection of the transverse web with the spars connected to the bridge spans into which connecting pins are insertable. By removal of both pins, the bridge spans can be disconnected from the transverse web and carried adjacent one another on a transporting vehicle, while removal of only the upper one of the connecting pins from its receiving holder enables the spans to pivot about the lower connecting pin so that the spans can be folded downwardly relative to the transverse web against one another so as to be transportable in a connected condition that is reduced in its transverse extent relative to its operational width.

6 Claims, 8 Drawing Figures

DEVICE FOR FOLDING THE SPANS OF A BRIDGE FOR TRANSPORT ON A VEHICLE

BACKGROUND AND SUMMARY OF THE INVENTION

The invention relates to a device for folding the spans of Bailey bridges for transport on a vehicle, said spans being arranged side-byside and mutually spaced by means of cross-pieces.

Transport of Bailey bridges on vehicles poses difficulties because the total width of the bridge in the operating state is far greater than the width of the vehicle, thus complicating transport on public roads.

It is therefore the goal of the invention to overcome this disadvantage and to provide a Bailey bridge which can be simply adapted to the width of the transport vehicle for transport.

This goal is achieved according to the invention by virtue of the fact that the crosspieces comprise spars as well as a central transverse web connected lengthwise with the spans, to which transverse web the two spans are attached with interposition of the spars, so that their positions can be changed. The transverse web according to the invention is provided with holders at its ends, said holders being disposed with intervals between them as viewed vertically, comprise connecting pins, and serve for permanent and/or temporary connection of the spars to the transverse web. Moreover, it is also provided according to the invention that the lower holder of the transverse web is designed as a pivot bearing, in which the spans, connected to the spars, can be unfolded downward with respect to one another. The spars together with the spans are releasably attached to the web of the crosspiece by connecting pins.

Bailey bridges are known (German Auslegeschrift No. 25 01 462) wherein the spans are separated from one another for folding, so that each span can be folded individually or the spans can be folded so that they lie next to each other. It is not the goal of these bridge designs to reduce the transport width.

On the other hand, the device according to the invention offers the possibility of reducing the width of a Bailey bridge to the point where the latter corresponds to the width of the transport vehicle. It is possible in simple fashion, according to the invention, to use the same device both for the operating state and for the resting and/or transport state of the bridge. In addition, a design with swivelably disposed spans makes it possible to change the bridge from the transport state to the operationally ready state in a minimum time, something which is a considerable advantage in the case of military bridges, since these bridges must be ready for use in the shortest possible time.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 5:
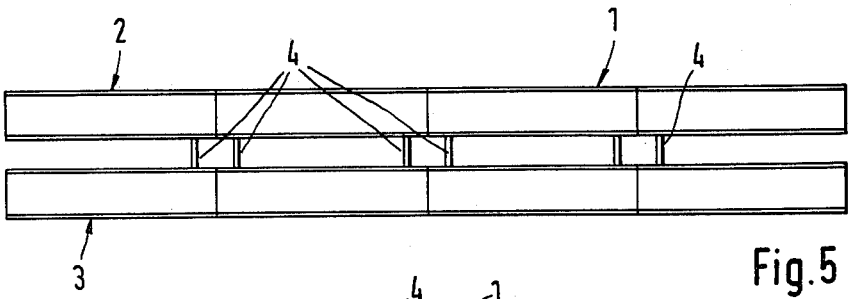
FIG. 5 is a top view of a bridge with crosspieces, composed of a plurality of bridge sections.

Bailey bridge 1 comprises two spans 2 and 3, firmly connected together and spaced apart by a plurality of crosspieces 4. Each bridge section of bridge 1 has at least two crosspieces 4 associated therewith (FIG. 5). Crosspiece 4 comprises two spars 5 and 6 and a central web 7 connecting these spars together. Spars 5 and 6 are mounted on the inner longitudinal sides of spans 2 and 3.

Spars 5 and 6 are connected to web 7 by holders 8 and 9 on each side, said holders being mounted with a space between them as viewed vertically, each holder being of a U-shape and together they define a recess 10 in spars 5 and 6 into which a tongue 11 on web 7 is inserted. Parts 5, 6, and 7 are connected by pins 12 and 13, which pass through a respective holder 8, 9 and tongue 11. After the pins are inserted they are locked in place, but can also be withdrawn depending on the operating state of the bridge. The pins are provided with a handle to facilitate handling.

Figure 1:
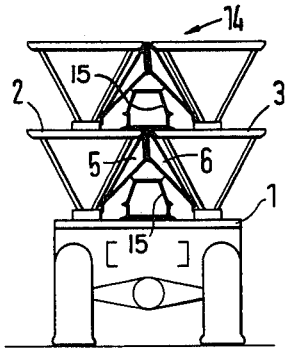
FIG. 1 is a first embodiment of a bridge with spans disposed side-by-side on a transport vehicle.

As FIG. 1 shows in greater detail, according to a first embodiment of the invention, web 7 can be released from spars 5 and 6 by withdrawing connecting pins 12 and 13 and web 7 can then be withdrawn. Spans 2 and 3 can then be placed close together, with no space between them, on the bed of the vehicle. Moreover, in this embodiment there is a provision for placing another bridge 14 on top of the first.

FIG. 1 also shows that laying beam sections 15 can be carried at the same time located below the spars 5, 6. Such laying beams are used for launching the bridge by a launching vehicle (not shown). In use for launching purposes the beams 15 are carried by the rollers 19 of the roller pairs 19, 20 (FIG. 3) as is known from commonly assigned U.S. application Ser. No. 87,865, filed Oct. 24, 1979, entitled "Bridge Laying Apparatus" with respect to which the present inventor is a co-inventor. This application is hereby incorporated by reference to the extent necessary to complete an understanding of the nature and use of beams 15 and roller pairs 12, 20.

Figure 2:
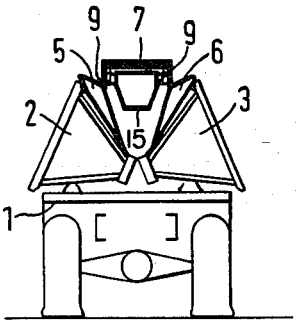
FIG. 2 is a second embodiment of a Bailey bridge with the spans unfolded downward.

In another operational embodiment according to FIG. 2, spans 2 and 3 are folded together downward without removal of transverse webs 3 or detachment of launching beam sections 15. For this purpose, the upper connecting pin 13 is withdrawn from the corresponding holder 8. The pin 12 therebelow remains in holder 9, so that a lower pivot bearing is produced which allows spans 2 and 3 to pivot toward the bed of vehicle 1.

These provisions for either removing web 7 completely between spars 5 and 6 and locating the spans 2 and 3 directly adjacent to one another, or articulating spans 2 and 3 pivotably on web 7 produces a width for transport which corresponds to the width of the road vehicle. On the other hand, this can be compared with FIG. 6 which shows the bridge being transported in the operating state, and extending considerably beyond the width of the vehicle.

Figure 3:
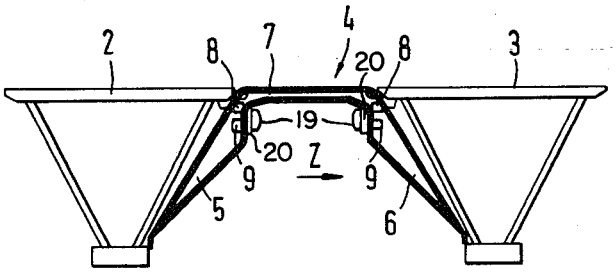
FIG. 3 is a cross section through a Bailey bridge in the operating state.
Figure 4:
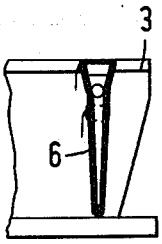
FIG. 4 is a view in direction Z in FIG. 3.
Figure 6:
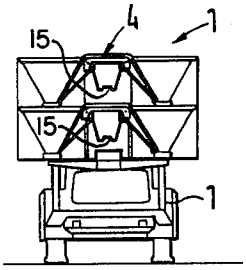
FIG. 6 is a view showing the transport of the bridge in the operating state, with the width unchanged.
Figure 7:
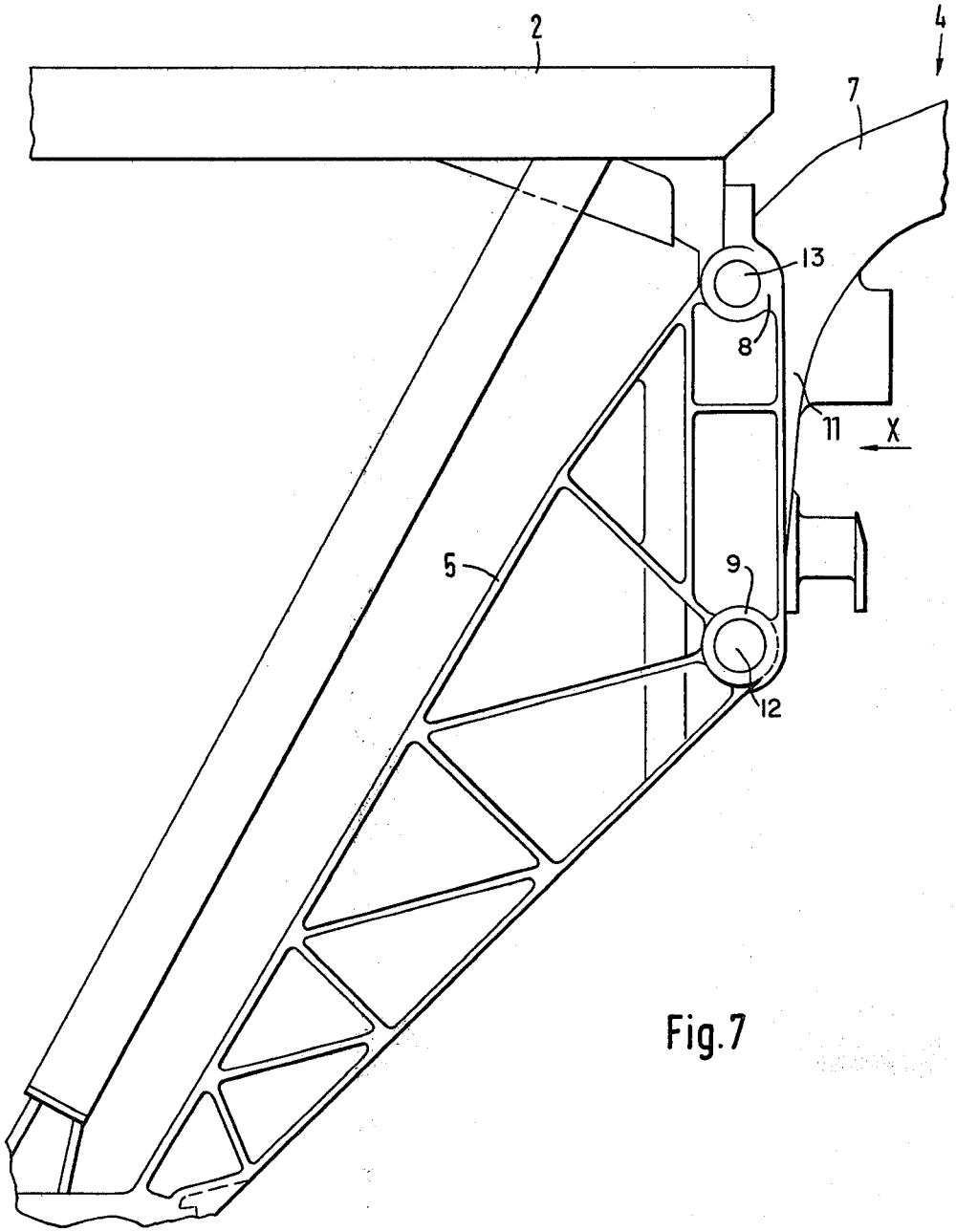
FIG. 7 is an enlarged view of a portion of the crosspiece with the spar and span.
Figure 8:
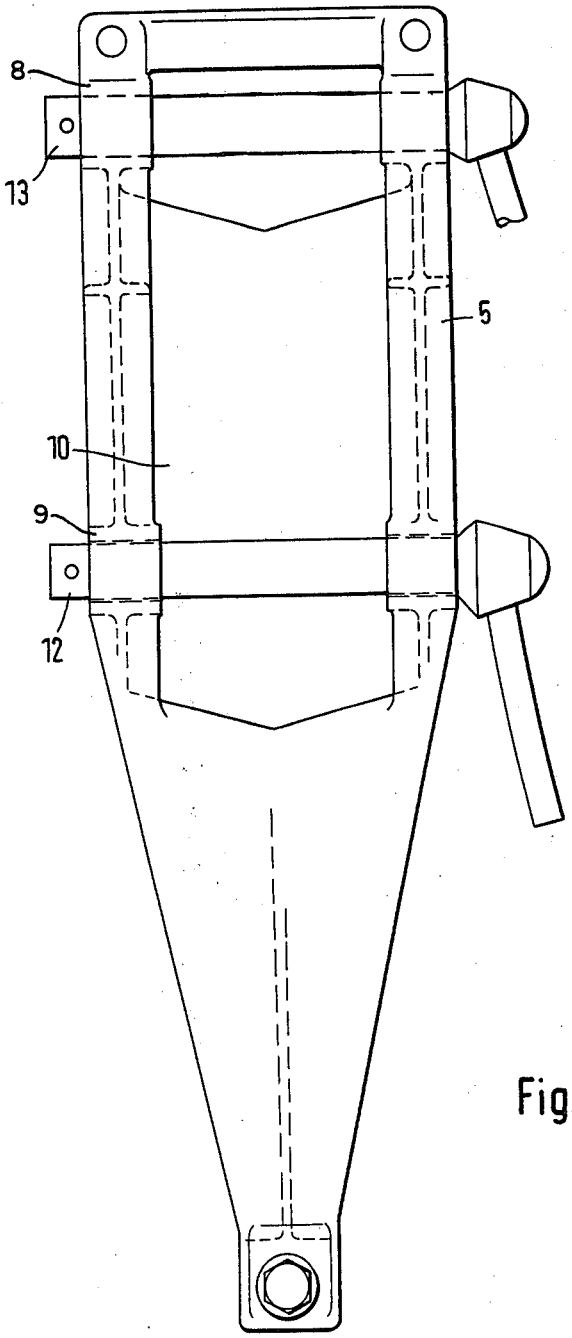
FIG. 8 is a view in direction X of FIG. 7, wherein only the spar is shown.

As can be seen from the foregoing, the present invention enables Bailey bridges to be transported in several modes as best suits logistical circumstances by being transportable in knock-down (FIG. 1), folded (FIG. 2) or operational conditions (FIGS. 3, 6).

While I have shown and described several embodiments in accordance with the present invention, it is understood that the same is not limited thereto but is susceptible of numerous changes and modifications as known to those skilled in the art and I therefore do not wish to be limited to the details shown and described herein but intend to cover all such changes and modifications as are encompassed by the scope of the appended claims.

I claim:

1. A transportable bridge unit comprising bridge spans located side-by-side and held apart by crosspieces, with a space between said spans, for transport aboard a vehicle, characterized by the fact that the crosspieces comprise spars connected heightwise to said bridge spans and to a central transverse web, which extends transversely between the spars at a central portion of the bridge, for interconnecting said bridge spans in a manner enabling the spans to change their positions relative to each other, wherein the transverse web is provided with pivot holders at its ends, said pivot holders being spaced from each other as viewed vertically, and further comprising connecting pins for connection of said bridge by joining of said spars with the transverse web.

2. Device according to claim 1, characterized by the fact that the spars are connected releasably with the transverse web by means of said connecting pins.

3. Bridge unit according to claims 1 or 2, characterized by the fact that a lower holder of the transverse web is designed as a pivot bearing about which the spans connected with the spars can be folded downward relative to said transverse web, against one another.

4. A transportable bridge unit comprising bridge spans located side-by-side and held apart by crosspieces, with a space between said spans, for transport aboard a vehicle, characterized by the fact that the crosspieces comprise rigid spars each of which is connected to one of said bridge spans and to a central transverse web, which extends transversely between the spars at a central portion of the bridge, by pivotal connecting means for rigidly interconnecting said bridge spans, said pivotal connecting means being at least partially disconnectable for enabling the spans to change their positions relative to each other between an in-use configuration capable of being traveled upon and a non-functional compacted vehicle transportable configuration.

5. Device according to claim 4, characterized by the fact that the spars are connected releasably with the transverse web by means of connecting pins.

6. Bridge unit according to claim 5, characterized by the fact that a lower holder of the transverse web is designed as a pivot bearing about which the spans connected with the spars can be folded downward relative to said transverse web, against one another.

* * * * *